US009971370B2

(12) United States Patent
Hu et al.

(10) Patent No.: US 9,971,370 B2
(45) Date of Patent: May 15, 2018

(54) VOLTAGE REGULATOR WITH REGULATED-BIASED CURRENT AMPLIFIER

(71) Applicant: Novatek Microelectronics Corp., Hsinchu (TW)

(72) Inventors: Min-Hung Hu, Hsinchu (TW); Chiu-Huang Huang, Hsinchu County (TW); Chen-Tsung Wu, Kaohsiung (TW); Juin-Wei Huang, Hsinchu County (TW); Pin-Han Su, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 262 days.

(21) Appl. No.: 14/887,287

(22) Filed: Oct. 19, 2015

(65) Prior Publication Data

US 2017/0108883 A1 Apr. 20, 2017

(51) Int. Cl.

| | |
|---|---|
| ***G05F 1/575*** | (2006.01) |
| ***G05F 1/565*** | (2006.01) |
| *G05F 1/59* | (2006.01) |

(52) U.S. Cl.

CPC ..... *G05F 1/575* (2013.01); *G05F 1/565* (2013.01); *G05F 1/59* (2013.01)

(58) Field of Classification Search

CPC ..... G05F 1/575; G05F 1/565; G05F 1/59

See application file for complete search history.

(56) References Cited

U.S. PATENT DOCUMENTS 5,559,424 A * 9/1996 Wrathall ..... G05F 3/20 323/277
6,465,994 B1 * 10/2002 Xi ..... G05F 1/575 323/274

(Continued)

FOREIGN PATENT DOCUMENTS

| | | |
|---|---|---|
| CN | 1633630 | 6/2005 |
| CN | 101520667 | 9/2009 |

(Continued)

OTHER PUBLICATIONS

"Office Action of Taiwan Counterpart Application", dated Jun. 7, 2016, p. 1-p. 4, in which the listed reference was cited.

(Continued)

*Primary Examiner* — Fred E Finch, III
*Assistant Examiner* — Rafael O De Leon Domenech
(74) *Attorney, Agent, or Firm* — JCIPRNET

(57) ABSTRACT

A voltage regulator including a voltage amplifier, a first output-stage, an AC-pass filter, a current amplifier, a second output-stage and a gain circuit is provided. Output terminals of the first and the second output-stages jointly provide the output voltage of the voltage regulator. Two input terminals of the voltage amplifier respectively receive a reference voltage and the output voltage. An input terminal of the first output-stage is coupled to an output terminal of the voltage amplifier. Two input terminals of the current amplifier respectively receive a reference current and the AC component of the output voltage. An input terminal of the second output-stage is coupled to an output terminal of the current amplifier. An input terminal of the gain circuit is coupled to the output terminal of the voltage amplifier. An output terminal of the gain circuit is coupled to the input terminal of the second output-stage.

20 Claims, 7 Drawing Sheets

(56) References Cited

U.S. PATENT DOCUMENTS

| | | | | |
|---|---|---|---|---|
| 6,703,816 | B2 * | 3/2004 | Biagi | G05F 1/575 323/275 |
| 6,765,374 | B1 | 7/2004 | Yang et al. | |
| 6,806,690 | B2 | 10/2004 | Xi | |
| 6,861,827 | B1 | 3/2005 | Yang et al. | |
| 7,106,032 | B2 * | 9/2006 | Chen | G05F 1/569 323/269 |
| 7,253,595 | B2 | 8/2007 | Oddoart et al. | |
| 7,327,125 | B2 | 2/2008 | Benbrik | |
| 8,384,305 | B2 | 2/2013 | Liao et al. | |
| 8,710,809 | B2 * | 4/2014 | Khare | G05F 1/563 323/266 |
| 8,866,460 | B2 | 10/2014 | Huang et al. | |
| 9,494,959 | B2 * | 11/2016 | Hu | G05F 1/565 |
| 2003/0178978 | A1 * | 9/2003 | Biagi | G05F 1/575 323/282 |
| 2003/0214275 | A1 * | 11/2003 | Biagi | G05F 1/575 323/280 |
| 2004/0004468 | A1 * | 1/2004 | Dearn | G05F 1/575 323/280 |
| 2005/0088153 | A1 * | 4/2005 | Suzuki | G05F 1/575 323/274 |
| 2005/0225306 | A1 | 10/2005 | Oddoart et al. | |
| 2006/0055383 | A1 * | 3/2006 | Eberlein | G05F 1/575 323/280 |
| 2007/0182399 | A1 | 8/2007 | Enjalbert | |
| 2008/0218139 | A1 | 9/2008 | Takagi | |
| 2009/0212753 | A1 * | 8/2009 | Lou | G05F 1/563 323/277 |
| 2012/0319665 | A1 * | 12/2012 | Hu | G05F 1/561 323/273 |
| 2013/0076323 | A1 | 3/2013 | Huang et al. | |
| 2013/0176006 | A1 * | 7/2013 | van Ettinger | G05F 1/56 323/265 |
| 2015/0212530 | A1 * | 7/2015 | Forejtek | G05F 1/56 323/280 |
| 2015/0318829 | A1 * | 11/2015 | Astgimath | H03F 3/505 381/120 |
| 2016/0124448 | A1 * | 5/2016 | Murukumpet | G05F 1/59 323/268 |

FOREIGN PATENT DOCUMENTS

| | | |
|---|---|---|
| CN | 103019285 | 4/2013 |
| CN | 103186155 | 7/2013 |
| CN | 104699163 | 6/2015 |
| TW | M502863 | 6/2015 |

OTHER PUBLICATIONS

Min-Hung Hu et al., "Current Source for Voltage Regulator and Voltage Regulator Thereof", Unpublished U.S. Appl. No. 14/554,009, filed Nov. 25, 2014, The specification, claims, and the drawings of the unpublished pending U.S. application have been stored in the Image File Wrapper (IFW) system.

"Office Action of China Counterpart Application," dated Aug. 25, 2017, p. 1-p. 5, in which the listed references were cited.

* cited by examiner

VOLTAGE REGULATOR WITH REGULATED-BIASED CURRENT AMPLIFIER

BACKGROUND

Field of the Invention

The invention relates to a voltage regulator and more particularly, to a voltage regulator having regulated-biased current amplifiers.

Description of Related Art

A voltage regulator is a commonly used voltage regulation circuit which locks an output voltage by using a feedback loop. FIG. 1 is a schematic diagram illustrating conventional voltage regulators 110 and 120 used inside an integrated circuit. The conventional voltage regulators 110 and 120 provides power to a load circuit 10 (e.g., a digital circuit or other functional circuits) via a power-supply route 11. The resistor symbols illustrated in FIG. 1 indicates the parasitic resistance of the power-supply route 11. The longer the power-supply route 11 is, the greater impedance the parasitic resistance have. The load circuit 10 may include a plurality of elements, wherein the elements respectively access (or receive) the power from different nodes of the power-supply route 11 (as schematically illustrated in FIG. 1). In order to reduce a voltage drop caused by a peak current flowing through the parasitic resistance of the power-supply route 11, in the circuit illustrated in FIG. 1, a voltage regulator 110 and a regulation capacitor 130 are disposed on the left end of the power-supply route 11, and a voltage regulator 120 and a regulation capacitor 140 are disposed on the right end of the power-supply route 11. In the integrated circuit, the capacitors 130 and the 140 occupy a great area. Due to the capacitors 130 and 140 having limited capacitances, the voltage regulators need to have fast responding speeds to compensate the peak current to stabilize voltages VDD1 and VDD2. In an scenario that the load circuit 10 is a digital circuit, a load current consumed by the load circuit 10 keeps dramatically changing due to high-speed operation of the digital circuit, such that the peak current of the load current would cause significant changes in the voltages (e.g., the voltages VDD1 and VDD2) of the power-supply route 11. Therefore, the voltage regulators require excellent responding speeds to compensate the peak current, so as to stabilize the voltages. The stabilized voltages of the power-supply route 11 can contribute to maintaining normal operation in the digital circuit (i.e., the load circuit 10). Nevertheless, the responding speeds of the conventional voltage regulators 110 and 120 may be too slow to compensate the peak current.

Additionally, when several conventional voltage regulators are used in the integrated circuit to provide the same power-supply route 11, an actual output voltage of each voltage regulator set varies from each other due to an offset voltage of each voltage regulator set. For example, it is assumed that in FIG. 1, the conventional voltage regulator 110 has an offset voltage Vos1, and the conventional voltage regulator 120 has an offset voltage Vos2. In case a reference voltage Vref is input to the conventional voltage regulators 110 and 120 in the same way, a preferable output voltage of the voltage regulator 110 should be Vref+Vos1, and a preferable output voltage of the voltage regulator 120 should be Vref+Vos2. The voltages VDD1 and VDD2 output by the voltage regulators 110 and 120 are in response to the load current of the load circuit 10 and the parasitic resistance of the power-supply route 11.

When Vos1>Vos2, and a transistor Ma is capable of providing a current sufficient for achieving VDD1AVG=Vref+Vos1 (wherein VDD1AVG represents an average of the voltage VDD1), the voltage regulator 110 in this condition can be normally operated, but would result in VDD2AVG>Vref+Vos2 (wherein VDD2AVG represents an average of the voltage VDD2), and VDD2AVG>Vref+Vos2 would cause a transistor Mb of the voltage regulator 120 to be turned off. In this case, the voltage regulator 120 is incapable of providing the peak current of the load circuit 10, thus, a node in the power-supply route 11 that has the greatest distance from the voltage regulator 110 generates the maximum voltage drop and thereby, the node becomes a weak point.

In another case, when Vos1>Vos2, but the transistor Ma is incapable of providing the sufficient current so that VDD1AVG<Vref+Vos1, the voltage regulator 120 in this condition can be normally operated, but the transistor Ma of the voltage regulator 110 reaches a fully-turn-on state. In this case, the voltage regulator 110 is incapable of providing the peak current to the load circuit 10 because that a control voltage of a gate of the transistor Ma is not provided with AC swing, thus, a node in the power-supply route 11 that has the greatest distance from the voltage regulator 120 generates the maximum voltage drop and thereby, the node becomes a weak point.

Consumption and the peak current of the load circuit 10 continuously raise up along with addition of new functions, such that each set of voltage regulators of the multi-regulator structure is incapable of simultaneous high-speed operation due to difference between the offset voltages (e.g., Vos1 and Vos2). The voltage regulators incapable of simultaneous high-speed operation cannot effectively provide the peak current to each of elements of the load circuit 10. The load circuit 10 easily occurs operational abnormality due to transient voltage drop at the weak point of the power-supply route 11.

SUMMARY

The invention provides a voltage regulator capable of generating corresponding currents to push output-stage circuits of the voltage regulator when a transient change occurs in a load current.

According to an embodiment of the invention, a voltage regulator including a first voltage amplifier, a first output-stage circuit, a first AC-pass filter, a first current amplifier, a second output-stage circuit and a first gain circuit is provided. A first input terminal of the first voltage amplifier receives a reference voltage. A second input terminal of the first voltage amplifier is coupled to a first output terminal of the voltage regulator to receive a first output voltage of the voltage regulator. An input terminal of the first output-stage circuit is coupled to an output terminal of the first voltage amplifier. An output terminal of the first output-stage circuit is coupled to the first output terminal of the voltage regulator. An input terminal of the first AC-pass filter is coupled to the first output terminal of the voltage regulator to receive the first output voltage. The first AC-pass filter is configured to filter a DC component of the first output voltage to output an AC component of the first output voltage. A first input terminal of the first current amplifier receives the reference current. A second input terminal of the first current amplifier is coupled to an output terminal of the first AC-pass filter to receive the AC component of the first output voltage. An input terminal of the second output-stage circuit is coupled to an output terminal of the first current amplifier. An output terminal of the second output-stage circuit is coupled to the first output terminal of the voltage regulator. An input terminal of the first gain circuit is coupled to the output terminal of the first voltage amplifier. An output terminal of the first gain circuit is coupled to the input terminal of the second output-stage circuit to regulate a DC level of a first bias voltage output for the first current amplifier.

To sum up, in the embodiments of the invention, the second output-stage circuits are driven by the current amplifiers fed back with the AC component of the second output voltage and thereby, can generate corresponding currents to push the output-stage circuits of the voltage regulator when a transient change occurs to the load current, so as to respond to the peak current of the load circuit.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
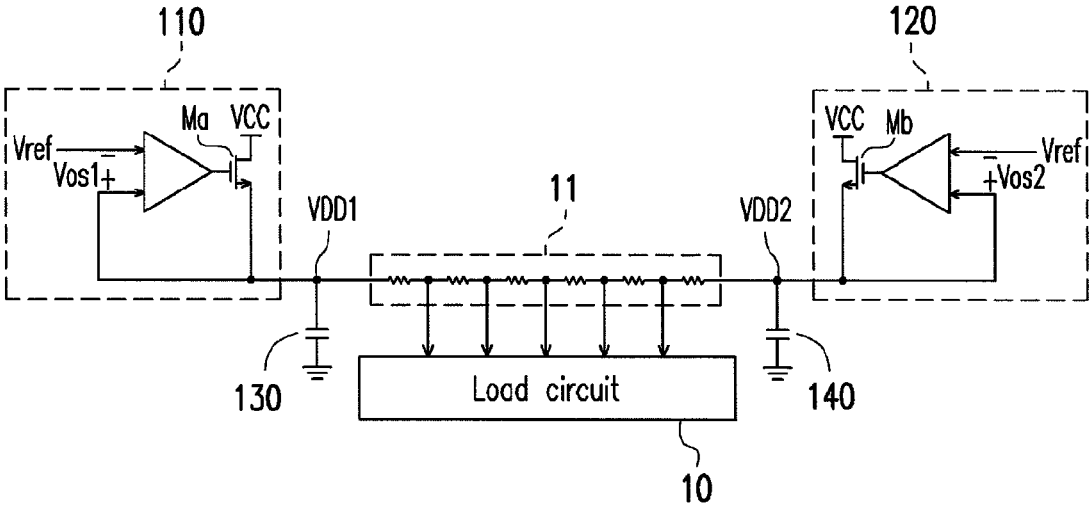
FIG. 1 (Related Art)
FIG. 1 is a schematic diagram illustrating conventional voltage regulators used inside an integrated circuit.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

Figure 2:
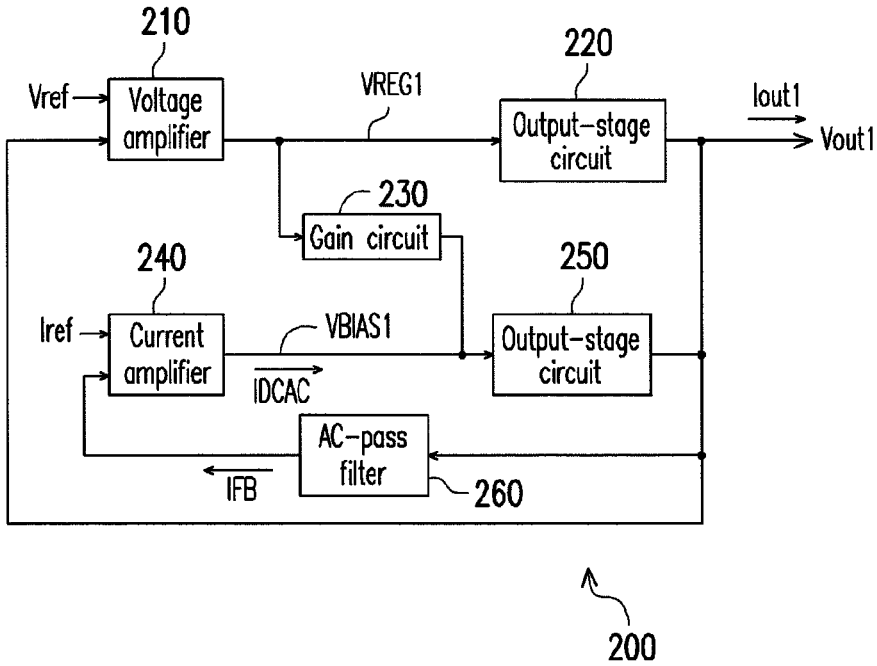
FIG. 2 is a schematic circuit block diagram illustrating a voltage regulator according to an embodiment of the invention.

FIG. 2 is a schematic circuit block diagram illustrating a voltage regulator 200 according to an embodiment of the invention. The voltage regulator 200 includes a first voltage amplifier 210, a first output-stage circuit 220, a first gain circuit 230, a first current amplifier 240, a second output-stage circuit 250 and a first AC-pass filter 260. The first voltage amplifier 210 may be any type of amplifier circuit, e.g., an operation amplifier, voltage comparator or any other amplifier circuit. A first input terminal of the first voltage amplifier 210 receives a reference voltage Vref. A level of the reference voltage Vref may be determined depending on actual design requirements. A second input terminal of the first voltage amplifier 210 is coupled to a first output terminal of the voltage regulator 200 to receive a first output voltage Vout1 from the voltage regulator 200. The first output voltage Vout1 may be provided to a power-supply route (which is not shown but will be described below) of a load circuit.

The first output-stage circuit 220 may be any type of output-stage circuit, e.g., a push-pull output circuit or any other output circuit. An input terminal of the first output-stage circuit 220 is coupled to an output terminal of the first voltage amplifier 210. An output terminal of the first output-stage circuit 220 is coupled to first output terminal of the voltage regulator 200. A regulation loop is formed by the first voltage amplifier 210 and the first output-stage circuit 220 and may detect a change of the first output voltage Vout1, so as to regulate a current of the first output-stage circuit 220. Thereby, an output current is equal to a load current, such that the first output voltage Vout1 is maintained in a rated level. After a change occurs in the first output voltage Vout1, the regulation loop formed by the first voltage amplifier 210 and the first output-stage circuit 220 is capable of immediately providing a DC component of the first output voltage Vout1.

An input terminal of the first gain circuit 230 is coupled to the output terminal of the first voltage amplifier 210. An output terminal of the first gain circuit 230 is coupled to the input terminal of the second output-stage circuit 250 to provide the first bias voltage VBIAS1. A voltage gain value of the first gain circuit 230 may be determined depending on actual design requirements. For instance, the voltage gain value of the first gain circuit 230 may be 1 or other real numbers. The first gain circuit 230 may be any type of gain circuit, e.g., a unity-gain buffer, a level shifter, a level-shifting unity-gain-buffer (LSUGB) or any other gain circuit.

An input terminal of the second output-stage circuit 250 is coupled to the output terminal of the first gain circuit 230 and an output terminal of the first current amplifier 240. An output terminal of the second output-stage circuit 250 is coupled to the first output terminal of the voltage regulator 200. The second output-stage circuit 250 may be any type of output-stage circuit, e.g., a push-pull output circuit or any other output circuit. The second output-stage circuit 250 and the first output-stage circuit 220 may jointly provide the first output voltage Vout1.

In the regulation loop formed by the first voltage amplifier 210 and the first output-stage circuit 220, the first voltage amplifier 210 may provide a bias voltage VREG1 with an accurate DC level. The first gain circuit 230 may correspondingly regulate the DC level of the first bias voltage VBIAS1 output by the first current amplifier 240 according to the bias voltage VREG1. Thus, the voltage level of the first bias voltage VBIAS1 may be adaptive and dynamically regulated according to the load current.

An input terminal of the first AC-pass filter 260 is coupled to the first output terminal of the voltage regulator 200 to receive the first output voltage Vout1. The first AC-pass filter 260 may filter the DC component of the first output voltage Vout1 to output an AC component of the first output voltage Vout1 (i.e., a feedback current IFB) to the first current amplifier 240. The first input terminal of the first current amplifier 240 receives a reference current Iref. A level of the reference current Iref may be determined depending on actual design requirements. A second input terminal of the first current amplifier 240 is coupled to an output terminal of the first AC-pass filter 260 to receive the AC component of the first output voltage Vout1. The first current amplifier 240 can provide the AC component of the first bias voltage VBIAS1.

The first AC-pass filter 260 and the first current amplifier 240 may implement an AC feedback. For the DC component, the first current amplifier 240 and the second output-stage circuit 250 does not form a DC loop. For the AC component, the first AC-pass filter 260, the first current amplifier 240 and the second output-stage circuit 250 form an AC loop. When the load current changes, the change of the current (i.e., the feedback current IFB) is fed back to the first current amplifier 240 through the first AC-pass filter 260, so as to adjust an output current IDCAC of the first current amplifier 240. The output current IDCAC may rapidly push the second output-stage circuit 250, such that the output current Iout1 achieves balance with the load current. The AC loop may detect a change of the output current Iout1 and respond to the change of the output current Iout1 in a high speed. Thus, after the change occurs in the output current Iout1, the AC loop formed by the first AC-pass filter 260, the first current amplifier 240 and the second output-stage circuit 250 is capable of rapidly and immediately providing the AC component of the first output voltage Vout1. When a speed of the AC loop is sufficiently fast, the AC loop may nearly eliminate the change of the first output voltage Vout1. In addition, the AC loop is better than a DC loop in maintaining stability, and thus, contributes to designing a regulation circuit with a higher bandwidth than an ordinary regulation circuit.

If it is assumed that a voltage difference between the bias voltage VREG1 and the first bias voltage VBIAS1 is VSHIFT, and a threshold voltage of each of the first output-stage circuit 220 and the second output-stage circuit 250 is VTH, VBIAS1=VREG1−VSHIFT=Vout1+VTH−VSHIFT. When VSHIFT>0, VBIAS1−Vout1=VTH−VSHIFT<VTH, which ensures the second output-stage circuit 250 to be in a stable state, without outputting any current. When a peak current occurs in the output current Iout1, the output current IDCAC of the first current amplifier 240 may rapidly push the second output-stage circuit 250, so as to output a great number of currents to compensate the peak current and stabilize the first output voltage Vout1. Therefore, the first gain circuit 230 may generate level conversion according to different VSHIFT designs, so as to further control an ON state of the second output-stage circuit 250. In addition, the first gain circuit 230 may also provide a buffer effect to prevent the first bias voltage VBIAS1 from unnecessary interference.

Figure 3:
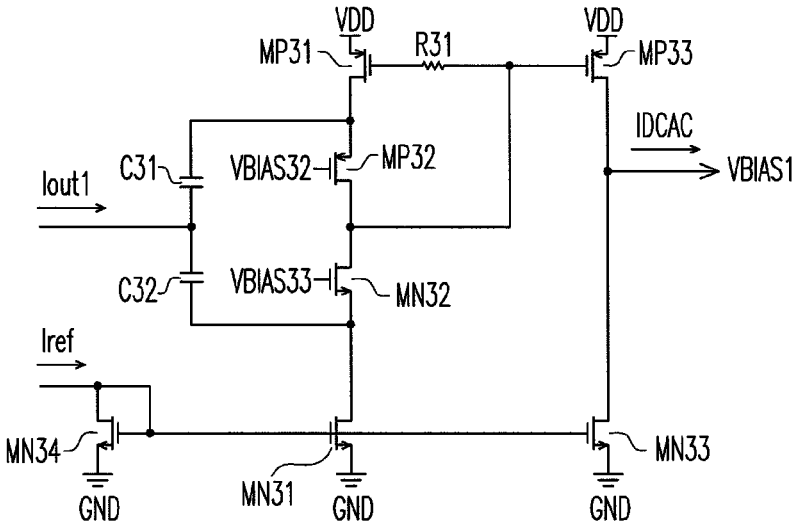
FIG. 3 is a schematic circuit diagram illustrating the first current amplifier depicted in FIG. 2 according to an embodiment of the invention.

The first current amplifier 240 may be an AC feedback current amplifier, a current mirror or any other current amplifier circuit. For instance, FIG. 3 is a schematic circuit diagram illustrating the first current amplifier 240 depicted in FIG. 2 according to an embodiment of the invention. FIG. 3 illustrates a current amplifier, which has a source capability toward the output current IDCAC. In the embodiment illustrated in FIG. 3, the first current amplifier 240 includes a first P-channel transistor MP31, a second P-channel transistor MP32, a third P-channel transistor MP33, a first N-channel transistor MN31, a second N-channel transistor MN32, a third N-channel transistor MN33, a fourth N-channel transistor MN34 and an resistor R31. The first AC-pass filter 260 includes a first capacitor C31 and a second capacitor C32. A first terminal (e.g., a source) of the first P-channel transistor MP31 is coupled to a first system voltage VDD. A first terminal (e.g., a source) of the second P-channel transistor MP32 is coupled to second terminal (e.g., a drain) of the first P-channel transistor MP31. A control terminal (e.g., a gate) of the second P-channel transistor MP32 is coupled to a second bias voltage VBIAS32. A level of the second bias voltage VBIAS32 may be determined depending on actual design requirements. A first terminal of the resistor R31 is coupled to a control terminal (e.g., a gate) of the first P-channel transistor MP31. A second terminal of the resistor R31 is coupled to second terminal (e.g., a drain) of the second P-channel transistor MP32. A first terminal (e.g., a source) of the third P-channel transistor MP33 is coupled to the first system voltage VDD. A control terminal (e.g., a gate) of the third P-channel transistor MP33 is coupled to the second terminal of the resistor R31. A second terminal (e.g., a drain) of the third P-channel transistor MP33 is coupled to the output terminal of the first current amplifier 240.

A first terminal (e.g., a source) of the fourth N-channel transistor MN34 is coupled to a second system voltage (e.g., a ground voltage GND). A second terminal (e.g., a drain) of the fourth N-channel transistor MN34 is coupled to the first input terminal of the first current amplifier 240 to receive the reference current Iref. A control terminal (e.g., a gate) of the fourth N-channel transistor MN34 is coupled to the second terminal of the fourth N-channel transistor MN34, a control terminal (e.g., a gate) of the first N-channel transistor MN31 and a control terminal (e.g., a gate) of the third N-channel transistor MN33. A first terminal (e.g., a source) of the first N-channel transistor MN31 is coupled to the second system voltage (e.g., the ground voltage GND). A first terminal (e.g., a source) of the second N-channel transistor MN32 is coupled to a second terminal (e.g., a drain) of the first N-channel transistor MN31. A control terminal (e.g., a gate) of the second N-channel transistor MN32 is coupled to a third bias voltage VBIAS33. A level of the third bias voltage VBIAS33 may be determined depending on actual design requirements. A second terminal (e.g., a drain) of the second N-channel transistor MN32 is coupled to the second terminal of the second P-channel transistor MP32. A first terminal of the third N-channel transistor MN33 is coupled to the second system voltage (e.g., the ground voltage GND). A second terminal (e.g., a drain) of the third N-channel transistor MN33 is coupled to second terminal of the third P-channel transistor MP33. Thus, the third P-channel transistor MP33 and the third N-channel transistor MN33 may jointly provide the first bias voltage VBIAS1 to the second output-stage circuit 250. Therein, the first current amplifier 240 generates/determines a DC component of the first bias voltage VBIAS1 (i.e., the output current IDCAC) according to the reference current Iref.

A first terminal of the first capacitor C31 is coupled to the second terminal of the first P-channel transistor MP31. A second terminal of the first capacitor C31 receives the first output voltage Vout1 (i.e., the output current Iout1). A first terminal of the second capacitor C32 is coupled to the second terminal of the first N-channel transistor MN31. A second terminal of the second capacitor C32 is coupled to the second terminal of the first capacitor C31. An AC component of the output current Iout1 (i.e., the feedback current IFB) is transmitted to the first current amplifier 240 through the first capacitor C31 and the second capacitor C32. Therein, the first current amplifier 240 generates/determines an AC component of the first bias voltage VBIAS1 (i.e., the output current IDCAC) according to the AC component of the output current Iout1 to reflect the change of the load current.

Figure 4:
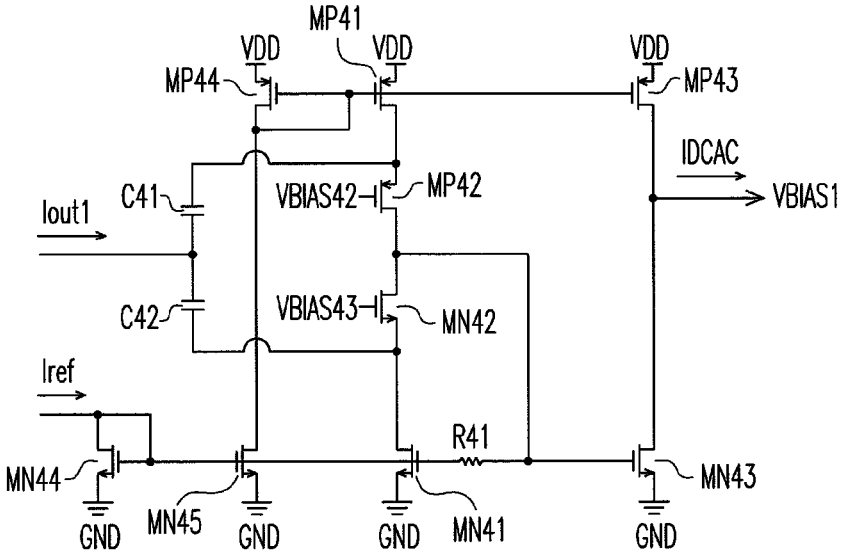
FIG. 4 is a schematic circuit diagram illustrating the first current amplifier depicted in FIG. 2 according to another embodiment of the invention.

FIG. 4 is a schematic circuit diagram illustrating the first current amplifier 240 depicted in FIG. 2 according to another embodiment of the invention. FIG. 4 illustrates a current amplifier, which has a sinking capability toward the output current IDCAC. In the embodiment illustrated in FIG. 4, the first current amplifier 240 includes a first P-channel transistor MP41, a second P-channel transistor MP42, a third P-channel transistor MP43, a fourth P-channel transistor MP44, a first N-channel transistor MN41, a second N-channel transistor MN42, a third N-channel transistor MN43, a fourth N-channel transistor MN44, a fifth N-channel transistor MN45 and a resistor R41. The first AC-pass filter 260 includes a first capacitor C41 and a second capacitor C42.

A first terminal (e.g., a source) of the first P-channel transistor MP41 is coupled to the first system voltage VDD. A first terminal (e.g., a source) of the second P-channel transistor MP42 is coupled to a second terminal (e.g., a drain) of the first P-channel transistor MP41. A control terminal (e.g., a gate) of the second P-channel transistor MP42 is coupled to a second bias voltage VBIAS42. A level of the second bias voltage VBIAS42 may be determined depending on actual design requirements. A first terminal (e.g., a source) of the third P-channel transistor MP43 is coupled to the first system voltage VDD. A second terminal (e.g., a drain) of the third P-channel transistor MP43 is coupled to the output terminal of the first current amplifier 240. A first terminal (e.g., a source) of the fourth P-channel transistor MP44 is coupled to the first system voltage VDD. A second terminal (e.g., a drain) of the fourth P-channel transistor MP44 is coupled to a control terminal (e.g., a gate) of the fourth P-channel transistor MP44, a control terminal (e.g., a gate) of the first P-channel transistor MP41 and a control terminal (e.g., a gate) of the third P-channel transistor MP43.

A first terminal (e.g., a source) of the fourth N-channel transistor MN44 is coupled to the second system voltage (e.g., the ground voltage GND). A second terminal (e.g., a drain) of the fourth N-channel transistor MN44 is coupled to the first input terminal of the first current amplifier 240 to receive the reference current Iref. A control terminal (e.g., a gate) of the fourth N-channel transistor MN44 is coupled to the second terminal of the fourth N-channel transistor MN44, a control terminal (e.g., a gate) of the fifth N-channel transistor MN45 and a control terminal (e.g., a gate) of the first N-channel transistor MN41. A first terminal (e.g., a source) of the fifth N-channel transistor MN45 is coupled to the second system voltage (e.g., the ground voltage GND). A second terminal (e.g., a drain) of the fifth N-channel transistor MN45 is coupled to the second terminal of the fourth P-channel transistor MP44. A first terminal (e.g., a source) of the first N-channel transistor MN41 is coupled to the second system voltage (e.g., the ground voltage GND). A first terminal (e.g., a source) of the second N-channel transistor MN42 is coupled to a second terminal (e.g., a drain) of the first N-channel transistor MN41. A control terminal (e.g., a gate) the second N-channel transistor MN42 is coupled to a third bias voltage VBIAS43. A level of the third bias voltage VBIAS43 may be determined depending on actual design requirements. A second terminal (e.g., a drain) of the second N-channel transistor MN42 is coupled to a second terminal (e.g., a drain) of the second P-channel transistor. A first terminal of the resistor R41 is coupled to the control terminal of the first N-channel transistor MN41. A second terminal of the resistor R41 is coupled to the second terminal of the second N-channel transistor MN42 and a control terminal (e.g., a gate) of the third N-channel transistor MN43. A first terminal (e.g., a source) of the third N-channel transistor MN43 is coupled to the second system voltage (e.g., the ground voltage GND). A second terminal (e.g., a drain) of the third N-channel transistor MN43 is coupled to the second terminal of the third P-channel transistor MP43. Thus, the third P-channel transistor MP43 and the third N-channel transistor MN43 may jointly provide the first bias voltage VBIAS1 to the second output-stage circuit 250. Therein, the first current amplifier 240 generates/determines the DC component of the first bias voltage VBIAS1 (i.e., the output current IDCAC) according to the reference current Iref.

A first terminal of the first capacitor C41 is coupled to the second terminal of the first P-channel transistor MP41. A second terminal of the first capacitor C41 receives the first output voltage Vout1 (i.e., the output current Iout1). A first terminal of the second capacitor C42 is coupled to the second terminal of the first N-channel transistor MN41. A second terminal of the second capacitor C42 is coupled to the second terminal of the first capacitor C41. AC component of the output current Iout1 (i.e., the feedback current IFB) is transmitted to the first current amplifier 240 through the first capacitor C41 and the second capacitor C42. Therein, the first current amplifier 240 generates/determines the AC component of the first bias voltage VBIAS1 (i.e., the output current IDCAC) according to the AC component of the output current Iout1 to reflect the change of the load current.

Figure 5:
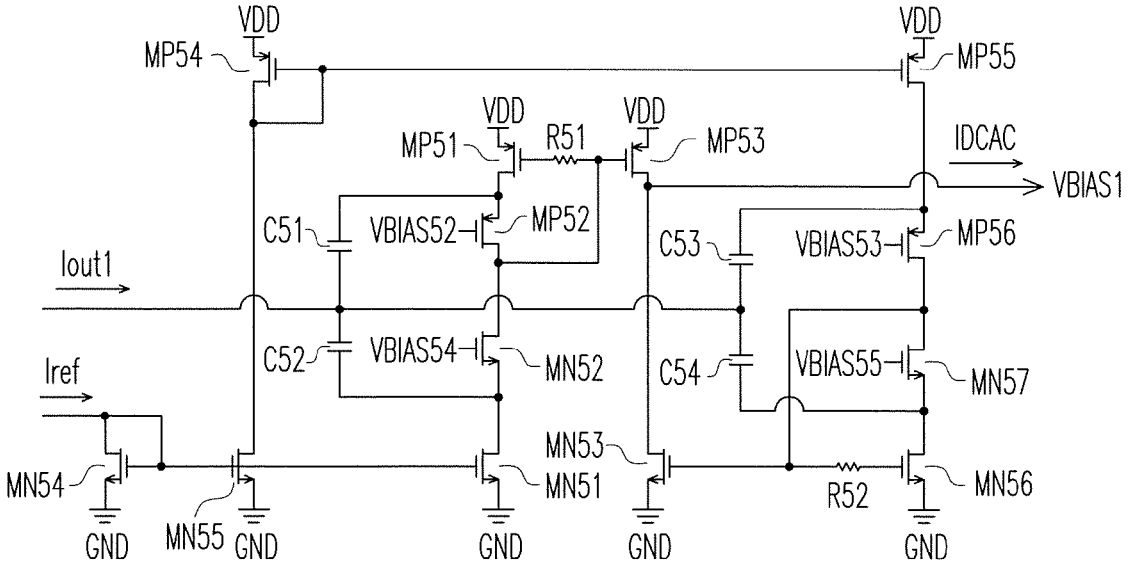
FIG. 5 is a schematic circuit diagram illustrating the first current amplifier depicted in FIG. 2 according to yet another embodiment of the invention.

FIG. 5 is a schematic circuit diagram illustrating the first current amplifier 240 depicted in FIG. 2 according to yet another embodiment of the invention. FIG. 5 illustrates a current amplifier, which has both a source and a sinking capabilities toward the output current IDCAC. In the embodiment illustrated in FIG. 5, the first current amplifier 240 includes a first P-channel transistor MP51, a second P-channel transistor MP52, a third P-channel transistor MP53, a fourth P-channel transistor MP54, a fifth P-channel transistor MP55, a sixth P-channel transistor MP56, a first N-channel transistor MN51, a second N-channel transistor MN52, a third N-channel transistor MN53, a fourth N-channel transistor MN54, a fifth N-channel transistor MN55, a sixth N-channel transistor MN56, a seventh N-channel transistor MN57, a first resistor R51 and a second resistor R52. The first AC-pass filter 260 includes a first capacitor C51, a second capacitor C52, a third capacitor C53 and a fourth capacitor C54.

A first terminal (e.g., a source) of the first P-channel transistor MP51 is coupled to the first system voltage VDD. A first terminal (e.g., a source) of the second P-channel transistor MP52 is coupled to second terminal (e.g., a drain) of the first P-channel transistor MP51. A control terminal (e.g., a gate) of the second P-channel transistor MP52 is coupled to the second bias voltage VBIAS52. A level of the second bias voltage VBIAS52 may be determined depending on actual design requirements. A first terminal of the first resistor R51 is coupled to a control terminal (e.g., a gate) of the first P-channel transistor MP51. A second terminal of the first resistor R51 is coupled to a second terminal (e.g., a drain) of the second P-channel transistor MP52 and a control terminal (e.g., a gate) of the third P-channel transistor MP53. A first terminal (e.g., a source) of the third P-channel transistor MP53 is coupled to the first system voltage VDD. A second terminal (e.g., a drain) of the third P-channel transistor MP53 is coupled to the output terminal of the first current amplifier 240.

A first terminal (e.g., a source) of the fourth P-channel transistor MP54 is coupled to the first system voltage VDD. A second terminal (e.g., a drain) of the fourth P-channel transistor MP54 is coupled to a control terminal (e.g., a gate) of the fourth P-channel transistor MP54 and a control terminal (e.g., a gate) of the fifth P-channel transistor MP55. A first terminal (e.g., a source) of the fifth P-channel transistor MP55 is coupled to the first system voltage VDD. A first terminal (e.g., a source) of the sixth P-channel transistor MP56 is coupled to second terminal (e.g., a drain) of the fifth P-channel transistor MP55. A control terminal (e.g., a gate) of the sixth P-channel transistor MP56 is coupled to a third bias voltage VBIAS53. A level of the third bias voltage VBIAS53 may be determined depending on actual design requirements.

A first terminal (e.g., a source) of the fourth N-channel transistor MN54 is coupled to the second system voltage (e.g., the ground voltage GND). A second terminal (e.g., a drain) of the fourth N-channel transistor MN54 is coupled to the first input terminal of the first current amplifier 240 to receive the reference current Iref. A control terminal (e.g., a gate) of the fourth N-channel transistor MN54 is coupled to the second terminal of the fourth N-channel transistor MN54, a control terminal (e.g., a gate) of the fifth N-channel transistor MN55 and a control terminal (e.g., a gate) of the first N-channel transistor MN51. A first terminal (e.g., a source) of the fifth N-channel transistor MN55 is coupled to the second system voltage (e.g., the ground voltage GND). A second terminal (e.g., a drain) of the fifth N-channel transistor MN55 is coupled to the second terminal of the fourth P-channel transistor MP54. A first terminal (e.g., a source) of the first N-channel transistor MN51 is coupled to the second system voltage (e.g., the ground voltage GND). A first terminal (e.g., a source) of the second N-channel transistor MN52 is coupled to a second terminal (e.g., a drain) of the first N-channel transistor MN51. A control terminal (e.g., a gate) of the second N-channel transistor MN52 is coupled to a fourth bias voltage VBIAS54. A level of the fourth bias voltage VBIAS54 may be determined depending on actual design requirements. A second terminal (e.g., a drain) of the second N-channel transistor MN52 is coupled to the second terminal of the second P-channel transistor MP52.

A first terminal (e.g., a source) of the third N-channel transistor MN53 is coupled to the second system voltage (e.g., the ground voltage GND). A second terminal (e.g., a drain) of the third N-channel transistor MN53 is coupled to the second terminal of the third P-channel transistor MP53. A first terminal of the second resistor R52 is coupled to a control terminal (e.g., a gate) of the third N-channel transistor MN53. A second terminal of the second resistor R52 is coupled to a control terminal (e.g., a gate) of the sixth N-channel transistor MN56. A first terminal (e.g., a source) of the sixth N-channel transistor MN56 is coupled to the second system voltage (e.g., the ground voltage GND). A first terminal (e.g., a source) of the seventh N-channel transistor MN57 is coupled to second terminal (e.g., a drain) of the sixth N-channel transistor MN56. A control terminal (e.g., a gate) of the seventh N-channel transistor MN57 is coupled to a fifth bias voltage VBIAS55. A level of the fifth bias voltage VBIAS55 may be determined depending on actual design requirements. A second terminal (e.g., a drain) of the seventh N-channel transistor MN57 is coupled to a second terminal (e.g., a drain) of the sixth P-channel transistor MP56 and the control terminal of the third N-channel transistor MN53. Thus, the third N-channel transistor MN53 and the third P-channel transistor MP53 may jointly provide the first bias voltage VBIAS1 to the second output-stage circuit 250. Therein, the first current amplifier 240 generates/determines the DC component of the first bias voltage VBIAS1 (i.e., the output current IDCAC) according to the reference current Iref.

A first terminal of the first capacitor C51 is coupled to the second terminal of the first P-channel transistor MP51. A second terminal of the first capacitor C51 receives the first output voltage Vout1 (i.e., the output current Iout1). A first terminal of the second capacitor C52 is coupled to the second terminal of the first N-channel transistor MN51. A second terminal of the second capacitor C52 is coupled to the second terminal of the first capacitor C51. A first terminal of the third capacitor C53 is coupled to the second terminal of the fifth P-channel transistor MP55. A second terminal of the third capacitor C53 receives the first output voltage Vout1 (i.e., the output current Iout1). A first terminal of the fourth capacitor C54 is coupled to the second terminal of the sixth N-channel transistor MN56. A second terminal of the fourth capacitor C54 is coupled to a second terminal of the third capacitor C53. The AC component of the output current Iout1 (i.e., the feedback current IFB) is transmitted to the first current amplifier 240 through the first capacitor C51, the second capacitor C52, the third capacitor C53 and the fourth capacitor C54. Therein, the first current amplifier 240 generates/determines the AC component of the first bias voltage VBIAS1 (i.e., the output current IDCAC) according to the AC component of the output current Iout1 to reflect the change of the load current.

Figure 6:
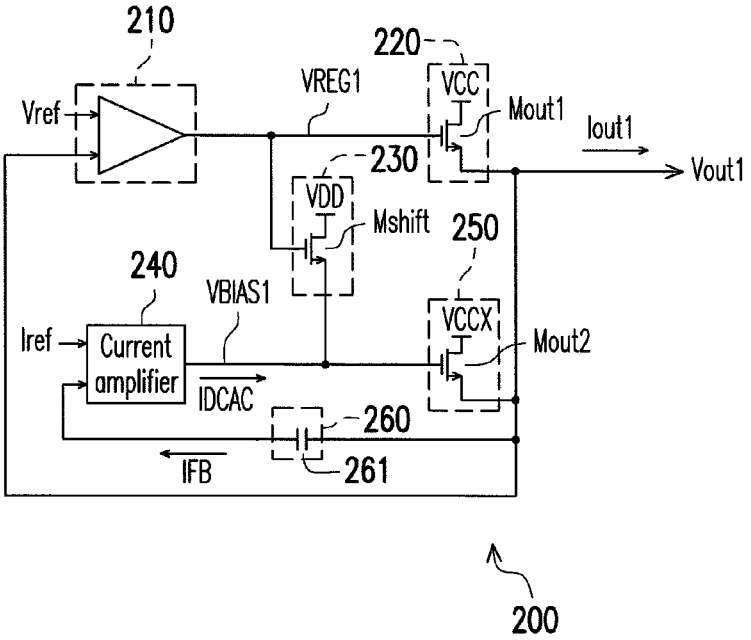
FIG. 6 is a schematic circuit diagram illustrating the first voltage amplifier, the first output-stage circuit, the first gain circuit, the second output-stage circuit and the first AC-pass filter depicted in FIG. 2 according to an embodiment of the invention.

FIG. 6 is a schematic circuit diagram illustrating the first voltage amplifier 210, the first output-stage circuit 220, the first gain circuit 230, the second output-stage circuit 250 and the first AC-pass filter 260 depicted in FIG. 2 according to an embodiment of the invention. In the embodiment of FIG. 6, the first voltage amplifier 210 may be an operation amplifier, in which a first input terminal of the operation amplifier receives the reference voltage Vref, a second input terminal of the operation amplifier receives the first output voltage Vout1 from the voltage regulator 200, and an output terminal of the operation amplifier outputs the bias voltage VREG1 to the first output-stage circuit 220.

The first output-stage circuit 220 includes a transistor Mout1. The transistor Mout1 may be a P-channel transistor, an N-channel transistor, a bipolar transistor or any other transistor. A first terminal (e.g., a drain) of the transistor Mout1 is coupled to the system voltage VCC. A level of the system voltage VCC may be determined depending on actual design requirements. For instance (but not limited to), the system voltage VCC may be 1.8 V or any other voltage level. A second terminal (e.g., a source) of the transistor Mout1 is coupled to the output terminal of the first output-stage circuit 220. A control terminal (e.g., a gate) of the transistor Mout1 is coupled to the input terminal of the first output-stage circuit 220 to receive the bias voltage VREG1.

In the embodiment illustrated in FIG. 6, the first AC-pass filter 260 includes a capacitor 261. A first terminal of the capacitor 261 is coupled to the input terminal of the first AC-pass filter 260. A second terminal of the capacitor 261 is coupled to the output terminal of the first AC-pass filter 260. Thus, the capacitor 261 may filter the DC component of the first output voltage Vout1 to output the AC component of the first output voltage Vout1 (feedback current IFB) to the first current amplifier 240.

In the embodiment illustrated in FIG. 6, the second output-stage circuit 250 includes a transistor Mout2. The transistor Mout2 may be a P-channel transistor, an N-channel transistor, a bipolar transistor or any other transistor. A first terminal (e.g., a drain) of the transistor Mout2 is coupled to a system voltage VCCX. A level of the system voltage VCCX may be determined depending on actual design requirements. For example (but not limited to), a level of the system voltage VCCX may be greater than or equal to the level of the system voltage VCC. A second terminal (e.g., a source) of the transistor Mout2 is coupled to an output terminal of the second output-stage circuit 250. A control terminal (e.g., a gate) of the transistor Mout2 is coupled to the input terminal of the second output-stage circuit 250 to receive the first bias voltage VBIAS1.

The transistor Mout2 may not have to load the DC component of the first output voltage Vout1, and thus, an area of the transistor Mout2 may be as small as possible. The smaller the area of the transistor Mout2 is, the faster a responding speed thereof is to a transient state. On the other hand, since the transistor Mout2 may contribute to provide the AC component of the first output voltage Vout1 to compensate the peak current of the load current, an area of the transistor Mout1 may be adaptively shrunk, which contributes to enhancement of the responding speed.

The first gain circuit 230 includes a transistor Mshift. The transistor Mshift may be a P-channel transistor, an N-channel transistor, a bipolar transistor or any other transistor. A first terminal (e.g., a drain) of the transistor Mshift is coupled to the system voltage VDD. A second terminal (e.g., a source) of the transistor Mshift is coupled to output terminal of the first gain circuit 230. A control terminal of the transistor Mshift (e.g., a gate) is coupled to the input terminal of the first gain circuit 230. If it is assumed that the voltage difference between the bias voltage VREG1 and the first bias voltage VBIAS1 is VSHIFT, and a threshold voltage of the transistor Mshift is VTH. When the transistor Mshift is turned on, VSHIFT=VTH. Thus, in a stable state, VBIAS1−Vout1=VTH−VSHIFT=VTH−VTH=0, i.e., the second output-stage circuit 250 is turned off and outputs no current. When the peak current occurs in the output current Iout1, the output current IDCAC of the first current amplifier 240 may rapidly push the first bias voltage VBIAS1 to raise over VTH to turn on the transistor Mout2, so as to output a great number of currents to compensate the peak current.

In other embodiments, a body of the transistor Mshift may be coupled to the control terminal (i.e., the gate) of the transistor Mshift. The first bias voltage VBIAS1 has to raise over VTH to turn on the transistor Mout2, thus, a time for raising up causes affection to a speed of the AC loop formed by the first AC-pass filter 260, the first current amplifier 240 and the second output-stage circuit 250. When the body of the transistor Mshift is coupled to the control terminal (i.e., the gate) of the transistor Mshift, the bias voltage VREG1 may provide a forward bias voltage to the body of the transistor Mshift. Thereby, VTH of the transistor Mshift is reduced, so as to enhance the responding speed of the AC loop.

Figure 7:
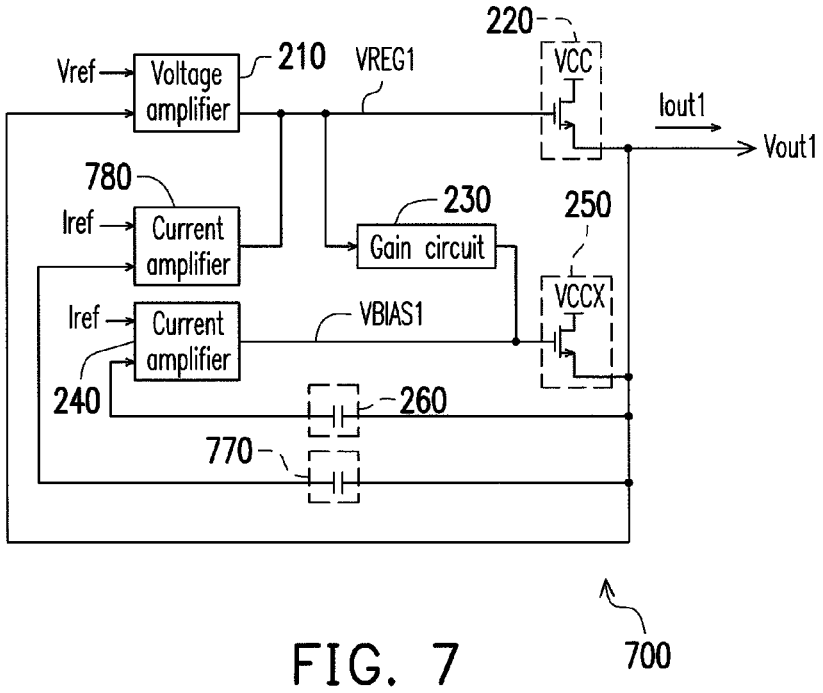
FIG. 7 is a schematic circuit block diagram illustrating a voltage regulator according to another embodiment of the invention.

FIG. 7 is a schematic circuit block diagram illustrating a voltage regulator 700 according to another embodiment of the invention. The voltage regulator 700 includes the first voltage amplifier 210, the first output-stage circuit 220, the first gain circuit 230, the first current amplifier 240, the second output-stage circuit 250, the first AC-pass filter 260, a second AC-pass filter 770 and a second current amplifier 780. The voltage regulator 700, the first voltage amplifier 210, the first output-stage circuit 220, the first gain circuit 230, the first current amplifier 240, the second output-stage circuit 250 and the first AC-pass filter 260 illustrated in FIG. 7 may be derived with reference to the descriptions related to the embodiments illustrated in FIG. 2 through FIG. 6 and thus, will not be repeatedly described.

Referring to FIG. 7, an input terminal of the second AC-pass filter 770 is coupled to a first output terminal of the voltage regulator 700 to receive the first output voltage Vout1. Details with respect to the implementation of the second AC-pass filter 770 may be derived with reference to the description related to the refer to the first AC-pass filter 260 and thus, will not be repeatedly described. The second AC-pass filter 770 may filter the DC component of the first output voltage Vout1 to output the AC component of the first output voltage Vout1. A first input terminal of the second current amplifier 780 receives the reference current Iref. A second input terminal of the second current amplifier 780 is coupled to an output terminal of the second AC-pass filter to receive the AC component of the first output voltage Vout1. An output terminal of the second current amplifier 780 is coupled to the output terminal of the first voltage amplifier 210.

The first output-stage circuit 220 and the second output-stage circuit 250 may be provided with different power sources to provide the first output voltage Vout1. When the load current changes, stable-state voltage levels of the bias voltage VREG1 and the first bias voltage VBIAS1 also have to change therewith. The second AC-pass filter 770 and the second current amplifier 780 may provide a second AC feedback loop. The second current amplifier 780 may push the first output-stage circuit 220 to accelerate responding speeds of the bias voltage VREG1 and the first bias voltage VBIAS1.

Figure 8:
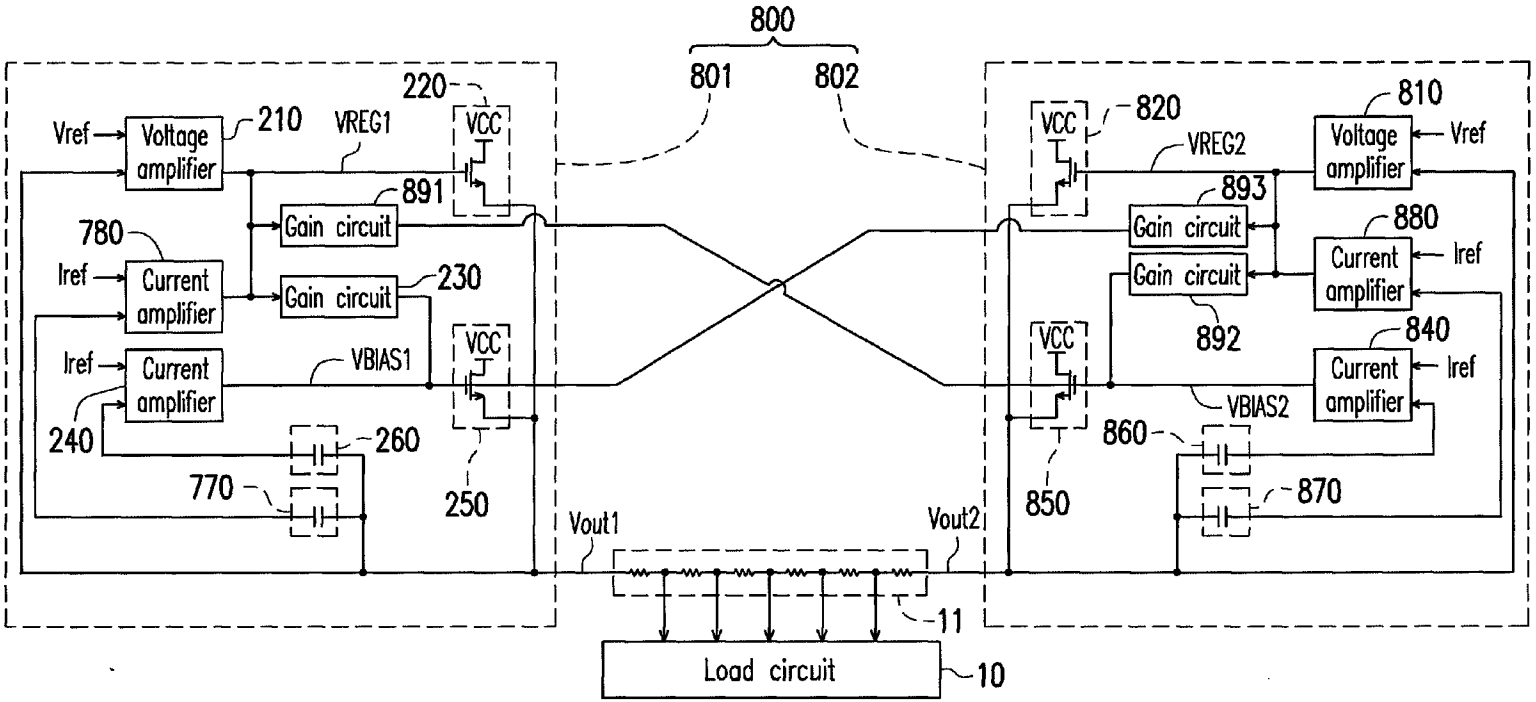
FIG. 8 is a schematic circuit block diagram illustrating a voltage regulator according to yet another embodiment of the invention.

FIG. 8 is a schematic circuit block diagram illustrating a voltage regulator 800 according to yet another embodiment of the invention. The voltage regulator 800 includes a plurality of regulation parts, e.g., regulation parts 801 and 802 illustrated in FIG. 8. Even though two regulation parts are illustrated in FIG. 8, in other embodiments, more regulation parts may be configured in the integrated circuit according to design requirements. The regulation parts may be configured near different nodes of the power-supply route 11 according to design requirements. For example (but not limited to), the regulation part 801 may be configured near a first terminal (i.e., a first node) of the power-supply route 11, while the regulation part 802 may be configured near a second terminal (i.e., a second node) of the power-supply route 11. The load circuit 10 and the power-supply route 11 illustrated in FIG. 8 may refer to the descriptions related to FIG. 1 and thus, will not be repeatedly described.

The regulation part 801 of the voltage regulator 800 includes the first voltage amplifier 210, the first current amplifier 240, the second current amplifier 780, the first gain circuit 230, the second gain circuit 891, the first output-stage circuit 220, the second output-stage circuit 250, the first AC-pass filter 260 and the second AC-pass filter 770. The regulation part 801 of the voltage regulator 800 illustrated in FIG. 8 may refer to the descriptions related to FIG. 7 and thus, will not be repeatedly described. A first output terminal of the voltage regulator 800 (i.e., an output terminal of the regulation part 801) may be coupled to the first node of the power-supply route 11 of the load circuit 10. An input terminal of the second gain circuit 891 of the regulation part 801 is coupled to the output terminal of the first voltage amplifier 210.

The regulation part 802 of the voltage regulator 800 includes a second voltage amplifier 810, a third current amplifier 840, a fourth current amplifier 880, a third gain circuit 892, a fourth gain circuit 893, a third output-stage circuit 820, a fourth output-stage circuit 850, a third AC-pass filter 860 and a fourth AC-pass filter 870. The regulation part 802 of the voltage regulator 800 illustrated in FIG. 8 may be derived with reference to the descriptions related to FIG. 7.

The second voltage amplifier 810 of the regulation part 802 may be any type of amplifier circuit, e.g., an operation amplifier, a voltage comparator or any other amplifier circuit. A first input terminal of the second voltage amplifier 810 receives the reference voltage Vref. The level of the reference voltage Vref may be determined depending on actual design requirements. A second input terminal of the second voltage amplifier 810 is coupled to a second output terminal (i.e., an output terminal of the regulation part 802) of the voltage regulator 800 to receive a second output voltage Vout2 from the voltage regulator 800. The second output terminal of the voltage regulator 800 (i.e., the output terminal of the regulation part 802) may be coupled to the second node of the power-supply route 11 of the load circuit 10.

The third output-stage circuit 820 may be any type of output-stage circuit, e.g., a push-pull output circuit or any other output circuit. An input terminal of the third output-stage circuit 820 is coupled to an output terminal of the second voltage amplifier 810. An output terminal of the third output-stage circuit 820 is coupled to the second output terminal of the voltage regulator 800 (i.e., the output terminal of the regulation part 802). The implementation of the third output-stage circuit 820 may be derived with reference to the descriptions related to the first output-stage circuit 220 illustrated in FIG. 2 through FIG. 6 and thus, will not be repeatedly described. A regulation loop is formed by the third output-stage circuit 820 and the second voltage amplifier 810 and may detect a change of the second output voltage Vout2, so as to regulate a current of the third output-stage circuit 820. Thereby, the output current is equal to the load current, such that the second output voltage Vout2 is maintained in a rated level. After a change occurs in the second output voltage Vout2, the regulation loop formed by the second voltage amplifier 810 and the third output-stage circuit 820 is capable of immediately providing a DC component of the second output voltage Vout2.

An input terminal of the third AC-pass filter 860 is coupled to the second output terminal of the voltage regulator 800 to receive the second output voltage Vout2. The third AC-pass filter 860 may filter the DC component of the second output voltage Vout2 to output an AC component of the second output voltage Vout2. An input terminal of the fourth AC-pass filter 870 is coupled to the second output terminal of the voltage regulator 800 to receive the second output voltage Vout2. The fourth AC-pass filter 870 may filter the DC component of the second output voltage Vout2 to output the AC component of the second output voltage Vout2. The implementations of the third AC-pass filter 860 and/or the fourth AC-pass filter 870 may be derived with reference to the descriptions related to the first AC-pass filter 260 illustrated in FIG. 2 through FIG. 7 and thus, will not be repeatedly described.

A first input terminal of the third current amplifier 840 receives the reference current Iref. The level of the reference current Iref may be determined depending on actual design requirements. A second input terminal of the third current amplifier 840 is coupled to an output terminal of the third AC-pass filter 860 to receive the AC component of the second output voltage Vout2. An input terminal of the fourth output-stage circuit 850 is coupled to an output terminal of the third current amplifier 840 and an output terminal of the second gain circuit 891. Thus, the second gain circuit 891 may correspondingly regulate the DC level of the second bias voltage VBIAS2 output by the third current amplifier 840 according to the bias voltage VREG1. An output terminal of the fourth output-stage circuit 850 is coupled to the second output terminal of the voltage regulator 800 (i.e., the of the regulation part 802). The implementations of the third current amplifier 840 and the fourth output-stage circuit 850 may be derived with reference to the descriptions related to the first current amplifier 240 and the second output-stage circuit 250 illustrated in FIG. 2 through FIG. 6 and thus, will not be repeatedly described.

An input terminal of the third gain circuit 892 is coupled to the output terminal of the second voltage amplifier 810. An output terminal of the third gain circuit 892 is coupled to the input terminal of the fourth output-stage circuit 850. An input terminal of the fourth gain circuit 893 is coupled to the output terminal of the second voltage amplifier 810, and an output terminal of the fourth gain circuit 893 is coupled to the input terminal of the second output-stage circuit 250. The implementations of the third gain circuit 892 and/or fourth gain circuit 893 may be derived with reference to the descriptions related to the first gain circuit 230 illustrated in FIG. 2 through FIG. 6 and thus, will not be repeatedly described. In the regulation loop formed by the second voltage amplifier 810 and the third output-stage circuit 820, the second voltage amplifier 810 may provide a bias voltage VREG2 with an accurate DC level. The third gain circuit 892 may correspondingly regulate the DC level of the second bias voltage VBIAS2 output by the third current amplifier 840 according to the bias voltage VREG2. Thus, the voltage level of the second bias voltage VBIAS2 may be has adaptive and dynamically regulated according to the load current. Similarly, the fourth gain circuit 893 may correspondingly regulate the DC level of the first bias voltage VBIAS1 output by the first current amplifier 240 according to bias voltage VREG2.

A first input terminal of the fourth current amplifier 880 receives the reference current Iref. A second input terminal of the fourth current amplifier 880 is coupled to an output terminal of the fourth AC-pass filter 870 to receive the AC component of the second output voltage Vout2. An output terminal of the fourth current amplifier 880 is coupled to the output terminal of the second voltage amplifier 810. The implementation of the fourth current amplifier 880 may be derived with reference to the descriptions related to the first current amplifier 240 illustrated in FIG. 2 through FIG. 5 and thus, will not be repeatedly described.

The plurality of regulation parts (e.g., the regulation parts 801 and 802 illustrated in FIG. 8) may perform cross-coupled biasing. In this case, each regulation loop affects each other due to a difference between offset voltages Vos of voltage amplifiers (e.g., 210 or 810). In any way, the loop between the regulation parts having the highest value of Vref+Vos provides regulated bias voltage (e.g., VBIAS1 and VBIAS2) to all the current amplifiers (e.g., 240 and 840), such that all the current amplifiers of the voltage regulator 800 may be maintained in the normal operation to jointly provide the peak current. Taking the regulation parts 801 and 802 illustrated in FIG. 8, if it is assumed that the voltage difference between the bias voltage VREG1 and the first bias voltage VBIAS1 (or the voltage difference between the bias voltage VREG2 and the second bias voltage VBIAS2) is VSHIFT, in this architecture, VBIAS1=VBIAS2=MAX [VREG1,VREG2]−VSHIFT, the first bias voltage VBIAS1 and the second bias voltage VBIAS2 may be ensured to have AC swing, such that the first current amplifier 240 and the third current amplifier 840 may be operated simultaneously to jointly compensate the peak current.

Figure 9:
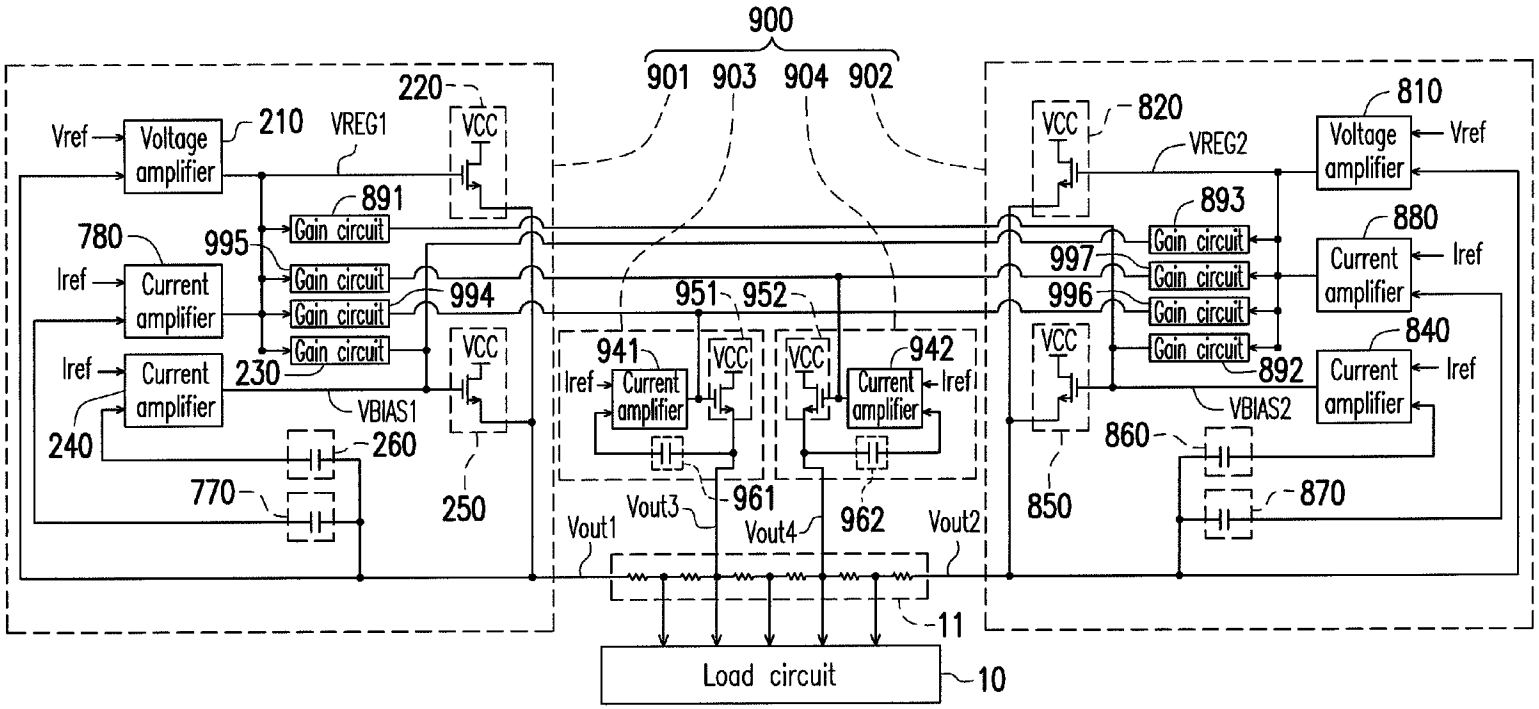
FIG. 9 is a schematic circuit block diagram illustrating a voltage regulator according to still another embodiment of the invention.

FIG. 9 is a schematic circuit block diagram illustrating a voltage regulator 900 according to still another embodiment of the invention. The voltage regulator 900 includes a plurality of regulation parts, e.g., regulation parts 901, 902, 903 and 904 illustrated in FIG. 9. Even though four regulation parts are illustrated in FIG. 9, in other embodiments, three or more may be configured in the integrated circuit according to design requirements. The regulation parts may be configured near different nodes of the power-supply route 11 according to design requirements. For example (but not limited to), the regulation part 901 may be configured near the first terminal (i.e., the first node) of the power-supply route 11, the regulation part 902 may be configured near the second terminal (i.e., the second node) of the power-supply route 11, the regulation part 903 may be configured near a third node in the power-supply route 11, and the regulation part 904 may be configured near a fourth node in the power-supply route 11. The load circuit 10 and the power-supply route 11 illustrated in FIG. 9 may be derived with reference to the description related to FIG. 1 and thus, will not be repeatedly described.

The regulation parts 901 and 902 of the voltage regulator 900 illustrated in FIG. 9 may be derived with reference to the descriptions related to the regulation parts 801 and 802 illustrated in FIG. 8 and thus, will not be repeatedly described. In the embodiment illustrated in FIG. 9, the voltage regulator 900 further includes the regulation parts 903 and 904.

The regulation part 903 includes a current amplifier 941, an output-stage circuit 951 and an AC-pass filter 961. An output terminal of the output-stage circuit 951 is coupled to a third output terminal of the voltage regulator 900 (i.e., an output terminal of the regulation part 903), where the third output terminal of the voltage regulator 900 may be coupled to the third node of the power-supply route 11. An input terminal of the AC-pass filter 961 is coupled to the third output terminal of the voltage regulator 900 (i.e., the output terminal of the regulation part 903) to receive a third output voltage Vout3 from the voltage regulator 900. The AC-pass filter 961 may filter a DC component of the third output voltage Vout3 to output AC component of the third output voltage Vout3. A first input terminal of the current amplifier 941 receives the reference current Iref. The level of the reference current Iref may be determined depending on actual design requirements. A second input terminal of the current amplifier 941 is coupled to an output terminal of the AC-pass filter 961 to receive the AC component of the third output voltage Vout3. An output terminal of the current amplifier 941 is coupled to an input terminal of the output-stage circuit 951. For the AC component, the AC-pass filter 961, the current amplifier 941 and the output-stage circuit 951 form an AC loop. When the load current changes, the change of the current is fed back to the current amplifier 941 through the AC-pass filter 961 to adjust an output current IDCAC of the output-stage circuit 951, such that the output current achieves balance with the load current.

The regulation part 904 includes a current amplifier 942, an output-stage circuit 952 and an AC-pass filter 962. An output terminal of the output-stage circuit 952 is coupled to a fourth output terminal of the voltage regulator 900 (i.e., an output terminal of the regulation part 904), where the fourth output terminal of the voltage regulator 900 may be coupled to the fourth node of the power-supply route 11. An input terminal of the AC-pass filter 962 is coupled to the fourth output terminal of the voltage regulator 900 (i.e., the output terminal of the regulation part 904) to receive a fourth output voltage Vout4 from the voltage regulator. The AC-pass filter 962 may filter a DC component of the fourth output voltage Vout4 to output an AC component of the fourth output voltage Vout4. A first input terminal of the current amplifier 942 receives the reference current Iref. A second input terminal of the current amplifier 942 is coupled to an output terminal of the AC-pass filter 962 to receive the AC component of the fourth output voltage Vout4. An output terminal of the current amplifier 942 is coupled to an input terminal of the output-stage circuit 952. For the AC component, the AC-pass filter 962, the current amplifier 942 and the output-stage circuit 952 form an AC loop. When the load current changes, the change of the current is fed back to the current amplifier 942 through the AC-pass filter 962 to adjust an output current of the output-stage circuit 952, such that the output current achieves balance with the load current.

In the voltage regulator 900 illustrated in FIG. 9, the regulation parts 901 further includes a gain circuit 994 and a gain circuit 995. Input terminals of the gain circuit 994 and the gain circuit 995 are coupled to the output terminal of the first voltage amplifier 210. An output terminal of the gain circuit 994 is coupled to the input terminal of the output-stage circuit 951 in the regulation part 903. Thus, the gain circuit 994 may correspondingly regulate a DC level of a bias voltage output by the current amplifier 941 according to the bias voltage VREG1. An output terminal of the gain circuit 995 is coupled to the input terminal of the output-stage circuit 952 in the regulation part 904. Thus, the gain circuit 995 may correspondingly regulate a DC level of a bias voltage output by the current amplifier 942 according to the bias voltage VREG1.

In the voltage regulator 900 illustrated in FIG. 9, the regulation parts 902 further includes a gain circuit 996 and a gain circuit 997. Input terminals of the gain circuit 996 and the gain circuit 997 are coupled to the output terminal of the second voltage amplifier 810. An output terminal of the gain circuit 996 is coupled to the input terminal of the output-stage circuit 951 in the regulation part 903. Thus, the gain circuit 996 may correspondingly regulate the DC level of the bias voltage output by the current amplifier 941 according to the bias voltage VREG2. An output terminal of the gain circuit 997 is coupled to the input terminal of the output-stage circuit 952 in the regulation part 904. Thus, the gain circuit 997 may correspondingly regulate the DC level of the bias voltage output by current amplifier 942 according to the bias voltage VREG2.

One or more regulation parts (e.g., 903 and 904) may be placed in different positions in the power-supply route 11 according to design requirements to mitigate affection caused by parasitic impedances of the power-supply route 11. The output stages in the regulation parts 903 and 904 provide current outputs (instead of voltage outputs), and thereby, the issue that the conventional voltage regulator cannot provide the peak current due to the voltage difference between the offset voltages thereof can be avoided.

Figure 10:
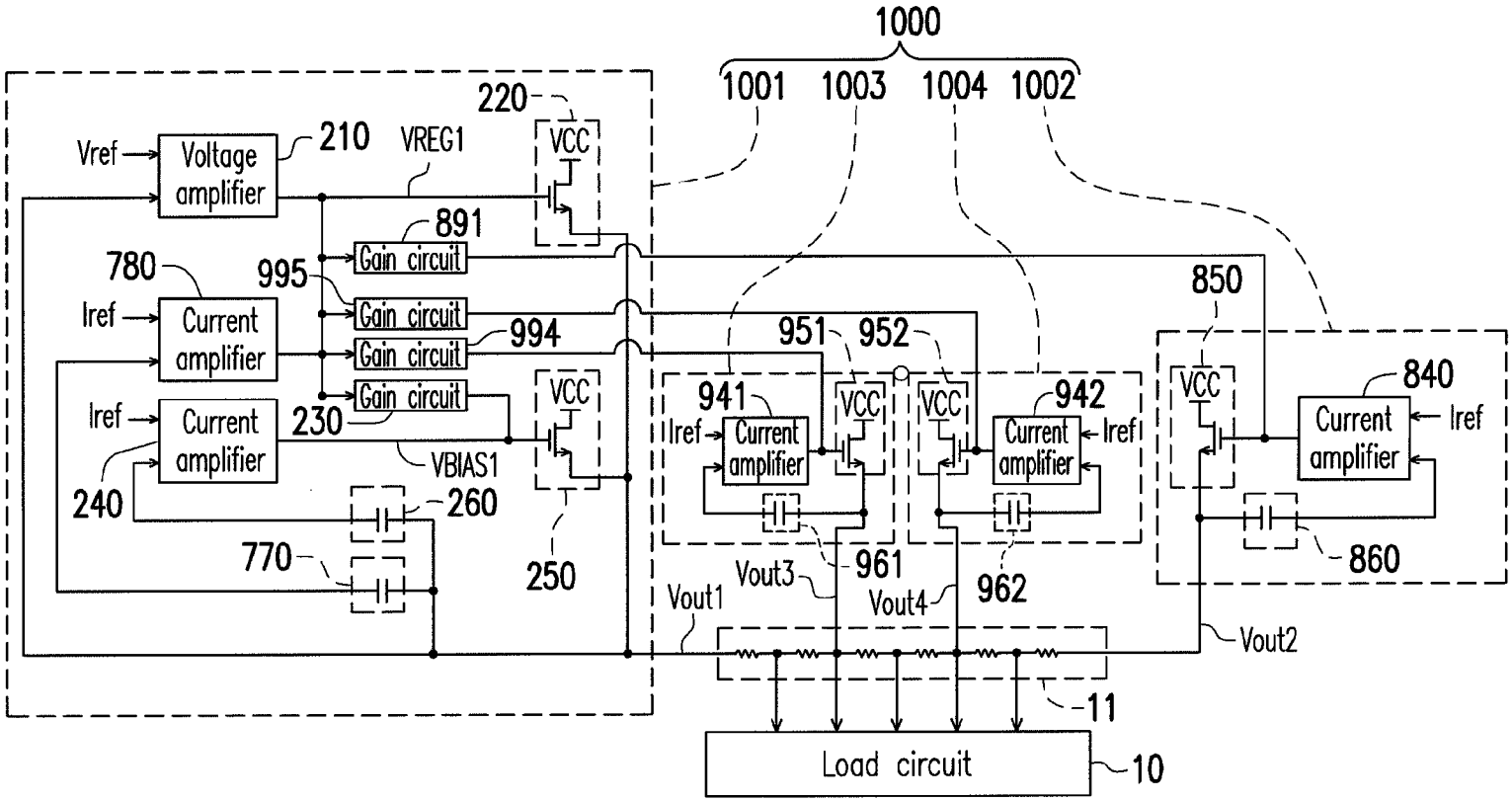
FIG. 10 is a schematic circuit block diagram illustrating a voltage regulator according to further another embodiment of the invention.

FIG. 10 is a schematic circuit block diagram illustrating a voltage regulator 1000 according to further another embodiment of the invention. The voltage regulator 1000 includes a plurality of regulation parts, e.g., regulation parts 1001, 1002, 1003 and 1004 illustrated in FIG. 10. Even though four regulation parts are illustrated in FIG. 10, in other embodiments, three or more may be configured in the integrated circuit according to design requirements. The regulation parts may be configured near different nodes of the power-supply route 11 according to design requirements. For example (but not limited to), the regulation part 1001 may be configured near the first terminal (i.e., the first node) of the power-supply route 11, the regulation part 1002 may be configured near the second terminal (i.e., the second node) of the power-supply route 11, the regulation part 1003 may be configured near the third node in the power-supply route 11, and the regulation part 1004 may be configured near the fourth node in the power-supply route 11. The load circuit 10 and the power-supply route 11 illustrated in FIG. 10 may be derived with reference to the description related to FIG. 1 and thus, will not be repeatedly described.

The regulation parts 1001, 1003 and 1004 of the voltage regulator 1000 illustrated in FIG. 10 may be derived with reference to the descriptions related to the regulation parts 901, 903 and 904 illustrated in FIG. 9 and thus, will not be repeatedly described. In the embodiment illustrated in FIG. 10, the regulation part 1002 may substitute for the regulation part 902 illustrated in FIG. 9.

The regulation part 1002 includes the current amplifier 840, the output-stage circuit 850 and the AC-pass filter 860. An input terminal of the output-stage circuit 850 is coupled to the output terminal of the second gain circuit 891. An output terminal of the output-stage circuit 850 is coupled to an second output terminal of the voltage regulator 1000 (i.e., an output terminal of the regulation part 1002), where the second output terminal of the voltage regulator 1000 may be coupled to the second node of the power-supply route 11. An input terminal of the AC-pass filter 860 is coupled to the second output terminal of the voltage regulator 1000 (i.e., the output terminal of the regulation part 1002) to receive the second output voltage Vout2 from the voltage regulator 1000. The AC-pass filter 860 may filter the DC component of the second output voltage Vout2 to output the AC component of the second output voltage Vout2. A first input terminal of the current amplifier 840 receives the reference current Iref. The level of the reference current Iref may be determined depending on actual design requirements. A second input terminal of the current amplifier 840 is coupled to an output terminal of the AC-pass filter 860 to receive the AC component of the second output voltage Vout2. An output terminal of the current amplifier 840 is coupled to the input terminal of the output-stage circuit 850. For the AC component, the AC-pass filter 860, the current amplifier 840 and the output-stage circuit 850 forms an AC loop (AC loop). When the load current changes, the change of the current is fed back to the current amplifier 840 through the AC-pass filter 860 to adjust an output current of the output-stage circuit 850, such that the output current achieves balance with the load current.

One or more regulation parts (e.g., the regulation parts 1002, 1003 and/or 1004) may be placed in different positions in the power-supply route 11 according to design requirements to mitigate affection caused by parasitic impedances of the power-supply route 11. The output stages in the regulation parts 1002, 1003 and/or 1004 provide current outputs (instead of voltage outputs), and thereby, the issue that the conventional voltage regulator cannot provide the peak current due to the voltage difference between the offset voltages thereof can be avoided.

To summarize, in the embodiments of the invention, the output-stage circuits of the voltage regulator driven by the current amplifiers fed back with the AC component. When the load current transiently changes, the current amplifier with the AC feedback can immediately generate the corresponding currents to push the output-stage circuits of the voltage regulator. Thereby, the voltage regulator described in each of the embodiments can respond to the peak current of the load circuit rapidly and immediately.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A voltage regulator, comprising:

a first voltage amplifier, having a first input terminal receiving a reference voltage, and a second input terminal coupled to a first output terminal of the voltage regulator to receive a first output voltage of the voltage regulator;

a first output-stage circuit, having an input terminal coupled to an output terminal of the first voltage amplifier, and an output terminal coupled to the first output terminal of the voltage regulator;

a first AC-pass filter, having an input terminal coupled to the first output terminal of the voltage regulator to receive the first output voltage, and configured to filter a DC component of the first output voltage to output an AC component of the first output voltage;

a first current amplifier, having a first input terminal receiving a reference current, and a second input terminal coupled to an output terminal of the first AC-pass filter to receive the AC component of the first output voltage;

a second output-stage circuit, having an input terminal coupled to an output terminal of the first current amplifier, and an output terminal coupled to the first output terminal of the voltage regulator; and a first gain circuit, having an input terminal coupled to the output terminal of the first voltage amplifier, and an output terminal coupled to the input terminal of the second output-stage circuit to regulate a DC level of a first bias voltage output by the first current amplifier.

2. The voltage regulator according to claim 1, wherein the first output-stage circuit is configured to provide the DC component of the first output voltage, and the second output-stage circuit is configured to provide the AC component of the first output voltage.

3. The voltage regulator according to claim 1, wherein the first voltage amplifier comprises an operation amplifier.

4. The voltage regulator according to claim 1, wherein the first output-stage circuit comprises:

a transistor, having a first terminal coupled to a system voltage, a second terminal coupled to the output terminal of the first output-stage circuit, and a control terminal coupled to the input terminal of the first output-stage circuit.

5. The voltage regulator according to claim 1, wherein the first AC-pass filter comprises a capacitor having a first terminal coupled to the input terminal of the first AC-pass filter and a second terminal coupled to the output terminal of the first AC-pass filter.

6. The voltage regulator according to claim 1, wherein the first current amplifier comprises an AC feedback current amplifier.

7. The voltage regulator according to claim 6, wherein the AC feedback current amplifier comprises:

a first P-channel transistor, having a first terminal coupled to a first system voltage;

a second P-channel transistor, having a first terminal coupled to a second terminal of the first P-channel transistor, and a control terminal coupled to a second bias voltage;

a resistor, having a first terminal coupled to a control terminal of the first P-channel transistor, a second terminal coupled to a second terminal of the second P-channel transistor;

a third P-channel transistor, having a first terminal coupled to the first system voltage, a control terminal coupled to the second terminal of the resistor, a second terminal coupled to the output terminal of the first current amplifier;

a first N-channel transistor, having a first terminal coupled to a second system voltage;

a second N-channel transistor, having a first terminal coupled to a second terminal of the first N-channel transistor, a control terminal coupled to a third bias voltage, and a second terminal coupled to the second terminal of the second P-channel transistor;

a third N-channel transistor, having a first terminal coupled to the second system voltage, and a second terminal coupled to the second terminal of the third P-channel transistor; and a fourth N-channel transistor, having a first terminal coupled to the second system voltage, a second terminal coupled to the first input terminal of the first current amplifier to receive the reference current, a control terminal coupled to the second terminal of the fourth N-channel transistor, a control terminal of the first N-channel transistor and a control terminal of the third N-channel transistor.

8. The voltage regulator according to claim 7, wherein the first AC-pass filter comprises:

a first capacitor, having a first terminal coupled to the second terminal of the first P-channel transistor; and a second capacitor, having a first terminal coupled to the second terminal of the first N-channel transistor, a second terminal coupled to a second terminal of the first capacitor.

9. The voltage regulator according to claim 6, wherein the AC feedback current amplifier comprises:

a first P-channel transistor, having a first terminal coupled to a first system voltage;

a second P-channel transistor, having a first terminal coupled to a second terminal of the first P-channel transistor, and a control terminal coupled to a second bias voltage;

a third P-channel transistor, having a first terminal coupled to the first system voltage, and a second terminal coupled to the output terminal of the first current amplifier;

a fourth P-channel transistor, having a first terminal coupled to the first system voltage, a second terminal coupled to a control terminal of the fourth P-channel transistor, a control terminal of the first P-channel transistor and a control terminal of the third P-channel transistor;

a first N-channel transistor, having a first terminal coupled to a second system voltage;

a second N-channel transistor, having a first terminal coupled to a second terminal of the first N-channel transistor, a control terminal coupled to a third bias voltage, and a second terminal coupled to a second terminal of the second P-channel transistor;

a resistor, having a first terminal coupled to the a control terminal of the first N-channel transistor, and a second terminal coupled to the second terminal of the second N-channel transistor;

a third N-channel transistor, having a first terminal coupled to the second system voltage, a second terminal coupled to the second terminal of the third P-channel transistor, and a control terminal coupled to the second terminal of the resistor;

a fourth N-channel transistor, having a first terminal coupled to the second system voltage, a second terminal coupled to the first input terminal of the first current amplifier to receive the reference current, and a control terminal coupled to the second terminal of the fourth N-channel transistor and the control terminal of the first N-channel transistor; and a fifth N-channel transistor, having a first terminal coupled to the second system voltage, a second terminal coupled to the second terminal of the fourth P-channel transistor, and a control terminal coupled to the control terminal of the fourth N-channel transistor.

10. The voltage regulator according to claim 9, wherein the first AC-pass filter comprises:

a first capacitor, having a first terminal coupled to the second terminal of the first P-channel transistor; and a second capacitor, having a first terminal coupled to the second terminal of the fifth N-channel transistor, and a second terminal coupled to a second terminal of the first capacitor.

11. The voltage regulator according to claim 6, wherein the AC feedback current amplifier comprises:

a first P-channel transistor, having a first terminal coupled to a first system voltage;

a second P-channel transistor, having a first terminal coupled to a second terminal of the first P-channel transistor, and a control terminal coupled to a second bias voltage;

a first resistor, having a first terminal coupled to a control terminal of the first P-channel transistor, and a second terminal coupled to a second terminal of the second P-channel transistor;

a third P-channel transistor, having a first terminal coupled to the first system voltage, a second terminal coupled to the output terminal of the first current amplifier, and a control terminal coupled to the second terminal of the first resistor;

a fourth P-channel transistor, having a first terminal coupled to the first system voltage, and a second terminal coupled to a control terminal of the fourth P-channel transistor;

a fifth P-channel transistor, having a first terminal coupled to the first system voltage, and a control terminal coupled to the control terminal of the fourth P-channel transistor;

a sixth P-channel transistor, having a first terminal coupled to a second terminal of the fifth P-channel transistor, and a control terminal coupled to a third bias voltage;

a first N-channel transistor, having a first terminal coupled to a second system voltage;

a second N-channel transistor, having a first terminal coupled to a second terminal of the first N-channel transistor, a control terminal coupled to a fourth bias voltage, and a second terminal coupled to the second terminal of the second P-channel transistor;

a third N-channel transistor, having a first terminal coupled to the second system voltage, and a second terminal coupled to the second terminal of the third P-channel transistor;

a fourth N-channel transistor, having a first terminal coupled to the second system voltage, a second terminal coupled to the first input terminal of the first current amplifier to receive the reference current, and a control terminal coupled to the second terminal of the fourth N-channel transistor and a control terminal of the first N-channel transistor;

a fifth N-channel transistor, having a first terminal coupled to the second system voltage, a second terminal coupled to the second terminal of the fourth P-channel transistor, and a control terminal coupled to the control terminal of the fourth N-channel transistor;

a second resistor, having a first terminal coupled to a control terminal of the third N-channel transistor;

a sixth N-channel transistor, having a first terminal coupled to the second system voltage, and a control terminal coupled to a second terminal of the second resistor; and a seventh N-channel transistor, having a first terminal coupled to a second terminal of the sixth N-channel transistor, a control terminal coupled to a fifth bias voltage, and a second terminal coupled to a second terminal of the sixth P-channel transistor and the control terminal of the third N-channel transistor.

12. The voltage regulator according to claim 11, wherein the first AC-pass filter comprises:

a first capacitor, having a first terminal coupled to the second terminal of the first P-channel transistor;

a second capacitor, having a first terminal coupled to the second terminal of the first N-channel transistor, and a second terminal coupled to a second terminal of the first capacitor;

a third capacitor, having a first terminal coupled to the second terminal of the fifth P-channel transistor; and a fourth capacitor, having a first terminal coupled to the second terminal of the sixth N-channel transistor, and a second terminal coupled to a second terminal of the third capacitor.

13. The voltage regulator according to claim 1, wherein the second output-stage circuit comprises:

a transistor, having a first terminal coupled to a system voltage, a second terminal coupled to the output terminal of the second output-stage circuit, and a control terminal coupled to the input terminal of the second output-stage circuit.

14. The voltage regulator according to claim 1, wherein the first gain circuit comprises:

a transistor, having a first terminal coupled to a system voltage, a second terminal coupled to the output terminal of the first gain circuit, and a control terminal coupled to the input terminal of the first gain circuit.

15. The voltage regulator according to claim 14, wherein a body of the transistor is coupled to the control terminal of the transistor.

16. The voltage regulator according to claim 1, further comprising:

a second AC-pass filter, having an input terminal coupled to the first output terminal of the voltage regulator to receive the first output voltage, and configured to filter the DC component of the first output voltage to output the AC component of the first output voltage; and a second current amplifier, having a first input terminal receiving the reference current, a second input terminal coupled to an output terminal of the second AC-pass filter to receive the AC component of the first output voltage, and an output terminal coupled to the output terminal of the first voltage amplifier.

17. The voltage regulator according to claim 16, wherein the first output terminal of the voltage regulator is configured to couple to a first node of a power-supply route of a load circuit, and the voltage regulator further comprises:

a second gain circuit, having an input terminal coupled to the output terminal of the first voltage amplifier;

a second voltage amplifier, having a first input terminal receiving the reference voltage, a second input terminal coupled to a second output terminal of the voltage regulator to receive a second output voltage of the voltage regulator, wherein the second output terminal of the voltage regulator is configured to couple to a second node of the power-supply route;

a third output-stage circuit, having an input terminal coupled to an output terminal of the second voltage amplifier, and an output terminal coupled to the second output terminal of the voltage regulator;

a third AC-pass filter, having an input terminal coupled to the second output terminal of the voltage regulator to receive the second output voltage, and configured to filter a DC component of the second output voltage to output an AC component of the second output voltage;

a fourth AC-pass filter, having an input terminal coupled to the second output terminal of the voltage regulator to receive the second output voltage, and configured to flirter the DC component of the second output voltage to output the AC component of the second output voltage;

a third current amplifier, having a first input terminal receiving the reference current, and a second input terminal coupled to an output terminal of the third AC-pass filter to receive the AC component of the second output voltage;

a fourth output-stage circuit, having an input terminal coupled to an output terminal of the third current amplifier and an output terminal of the second gain circuit, and an output terminal coupled to the second output terminal of the voltage regulator;

a third gain circuit, having an input terminal coupled to the output terminal of the second voltage amplifier, and an output terminal coupled to the input terminal of the fourth output-stage circuit;

a fourth gain circuit, having an input terminal coupled to the output terminal of the second voltage amplifier, and an output terminal coupled to the input terminal of the second output-stage circuit; and a fourth current amplifier, having a first input terminal receiving the reference current, a second input terminal coupled to an output terminal of the fourth AC-pass filter to receive the AC component of the second output voltage, and an output terminal coupled to the output terminal of the second voltage amplifier.

18. The voltage regulator according to claim 17, further comprising:

a fifth gain circuit, having an input terminal coupled to the output terminal of the first voltage amplifier;

a sixth gain circuit, having an input terminal coupled to the output terminal of the second voltage amplifier;

a fifth output-stage circuit, having an input terminal coupled to an output terminal of the fifth gain circuit and an output terminal of the sixth gain circuit, and an output terminal coupled to a third output terminal of the voltage regulator, wherein the third output terminal of the voltage regulator is configured to couple to a third node of the power-supply route;

a fifth AC-pass filter, having an input terminal coupled to the third output terminal of the voltage regulator to receive a third output voltage of the voltage regulator, and configured to filter a DC component of the third output voltage to output an AC component of the third output voltage; and a fifth current amplifier, having a first input terminal receiving the reference current, a second input terminal coupled to an output terminal of the fifth AC-pass filter to receive the AC component of the third output voltage, and an output terminal coupled to the input terminal of the fifth output-stage circuit.

19. The voltage regulator according to claim 16, wherein the first output terminal of the voltage regulator is configured to couple to a first node of a power-supply route of a load circuit, and the voltage regulator further comprises:

a second gain circuit, having an input terminal coupled to the output terminal of the first voltage amplifier;

a third output-stage circuit, having an input terminal coupled to an output terminal of the second gain circuit, and an output terminal coupled to a second output terminal of the voltage regulator, wherein the second output terminal of the voltage regulator is configured to couple to a second node of the power-supply route;

a third AC-pass filter, having an input terminal coupled to the second output terminal of the voltage regulator to receive a second output voltage of the voltage regulator, and configured to filter a DC component of the second output voltage to output an AC component of the second output voltage; and a third current amplifier, having a first input terminal receiving the reference current, a second input terminal coupled to an output terminal of the third AC-pass filter to receive the AC component of the second output voltage, and an output terminal coupled to the input terminal of the third output-stage circuit.

20. The voltage regulator according to claim 19, further comprising:

a third gain circuit, having an input terminal coupled to the output terminal of the first voltage amplifier;

a fourth output-stage circuit, having an input terminal coupled to an output terminal of the third gain circuit, and an output terminal coupled to a third output terminal of the voltage regulator, wherein the third output terminal of the voltage regulator is configured to couple to a third node of the power-supply route;

a fourth AC-pass filter, having an input terminal coupled to the third output terminal of the voltage regulator to receive a third output voltage of the voltage regulator, and configured to filter a DC component of the third output voltage to output an AC component of the third output voltage; and a fourth current amplifier, having a first input terminal receiving the reference current, a second input terminal coupled to an output terminal of the fourth AC-pass filter to receive the AC component of the third output voltage, and an output terminal coupled to the input terminal of the fourth output-stage circuit.

* * * * *